US010465345B2

(12) United States Patent
Exline et al.

(10) Patent No.: US 10,465,345 B2
(45) Date of Patent: Nov. 5, 2019

(54) APPARATUS AND METHOD FOR APPLYING ASPHALT BINDER COMPOSITIONS INCLUDING VOID REDUCING ASPHALT MEMBRANE COMPOSITIONS FOR PAVING APPLICATIONS

(71) Applicant: Heritage Research Group, Indianapolis, IN (US)

(72) Inventors: Marvin Keller Exline, Terre Haute, IN (US); James Joseph Cunningham, Greensburg, PA (US); Anthony J. Kriech, Indianapolis, IN (US)

(73) Assignee: Heritage Research Group, Indianapolis, IN (US)

( * ) Notice: Subject to any disclaimer, the term of this patent is extended or adjusted under 35 U.S.C. 154(b) by 0 days.

(21) Appl. No.: 15/787,427

(22) Filed: Oct. 18, 2017

(65) Prior Publication Data

US 2018/0038056 A1 Feb. 8, 2018

Related U.S. Application Data

(63) Continuation of application No. 15/401,990, filed on Jan. 9, 2017, now Pat. No. 9,822,495, which is a (Continued)

(51) Int. Cl.
*E01C 19/17* (2006.01)
*B05B 13/00* (2006.01)

(Continued)

(52) U.S. Cl.
CPC ..... *E01C 19/176* (2013.01); *B05B 12/04* (2013.01); *B05B 13/005* (2013.01); *B05D 1/02* (2013.01);

(Continued)

(58) Field of Classification Search
USPC ..... 118/305, 323, 313–315; 239/146, 157, 239/159, 163, 166; 404/94, 111; 15/78
See application file for complete search history.

(56) References Cited

U.S. PATENT DOCUMENTS 1,341,458 A 5/1920 Everett
1,411,777 A 4/1922 Everett (Continued)

FOREIGN PATENT DOCUMENTS

CN 1834160 A 9/2006
CN 102154975 A 8/2011

(Continued)

OTHER PUBLICATIONS

English Translation EP-0643171A1, Mar. 15, 1995 (Year: 1995).*

(Continued)

*Primary Examiner* — Yewebdar T Tadesse
(74) *Attorney, Agent, or Firm* — Brinks Gilson & Lione

(57) ABSTRACT

An apparatus for applying an asphalt binder composition to a roadway during construction or repair of an asphalt pavement which apparatus include: a mobile vehicle having a chassis extending in a longitudinal direction which longitudinal direction is aligned with a forward/rearward direction of travel of said mobile vehicle; at least one storage tank supported on the chassis containing an asphalt binder composition; and at least one spray nozzle configured to dispense the asphalt binder composition from the at least one storage tank in a longitudinal strip or band having a width that is no greater that a width of the asphalt binder composition dispensed by one of the at least one spray nozzle. The at least one spray nozzle can include a plurality of spray nozzles that are coupled to a common spray bar. According to one embodiment the asphalt binder composition is a void (Continued)

reducing asphalt membrane composition that is provided between adjacent asphalt pavement passes.

11 Claims, 4 Drawing Sheets

Related U.S. Application Data continuation of application No. 15/064,814, filed on Mar. 9, 2016, now abandoned.

(60) Provisional application No. 62/130,918, filed on Mar. 10, 2015, provisional application No. 62/302,338, filed on Mar. 2, 2016.

(51) Int. Cl.

| | |
|---|---|
| ***E01C 19/00*** | (2006.01) |
| ***E01C 23/06*** | (2006.01) |
| ***B05B 12/04*** | (2006.01) |
| ***B05D 1/02*** | (2006.01) |
| ***B05D 1/38*** | (2006.01) |
| ***B05D 3/04*** | (2006.01) |
| ***B05D 3/10*** | (2006.01) |
| ***B05D 5/00*** | (2006.01) |
| ***E01C 11/00*** | (2006.01) |

(52) U.S. Cl.

CPC ..... *B05D 1/38* (2013.01); *B05D 3/048* (2013.01); *B05D 3/108* (2013.01); *B05D 5/005* (2013.01); *E01C 11/005* (2013.01); *E01C 19/004* (2013.01); *E01C 19/006* (2013.01); *E01C 23/06* (2013.01)

(56) References Cited

U.S. PATENT DOCUMENTS

| | | | | |
|---|---|---|---|---|
| 2,076,172 | A | 4/1937 | Bowden | |
| 2,330,568 | A | 5/1941 | Erickson | |
| 2,821,890 | A | 7/1958 | Wilson | |
| 3,259,122 | A | 7/1966 | Lenker | |
| 3,763,074 | A | 10/1973 | Rostler | |
| 3,870,426 | A | 3/1975 | Keitzman | |
| 4,113,401 | A | 9/1978 | McDonald | |
| 4,181,449 | A | 1/1980 | Lenker | |
| 4,327,666 | A | 5/1982 | Lee | |
| 4,462,547 | A * | 7/1984 | Metz | E01C 23/166 165/146 |
| 4,464,427 | A | 8/1984 | Barlow | |
| 4,511,283 | A | 4/1985 | Duval et al. | |
| 4,511,284 | A | 4/1985 | Sterner | |
| 4,592,507 | A | 6/1986 | Benedict | |
| 4,630,965 | A | 12/1986 | Nguyen et al. | |
| 4,678,363 | A | 7/1987 | Sterner | |
| 4,682,909 | A | 7/1987 | Mihara | |
| 4,817,870 | A * | 4/1989 | Dalton | B05B 9/06 239/157 |
| 5,026,609 | A | 6/1991 | Jacob | |
| 5,051,026 | A | 9/1991 | Sovik | |
| 5,088,854 | A | 2/1992 | Sovik | |
| 5,131,788 | A | 7/1992 | Hulicsko | |
| 5,232,306 | A | 8/1993 | Sterner | |
| 5,263,790 | A | 11/1993 | Bickley | |
| 5,297,893 | A * | 3/1994 | Corcoran | E01C 19/176 404/72 |
| 5,333,969 | A | 8/1994 | Blaha et al. | |
| 5,362,176 | A | 11/1994 | Sovik | |
| 5,419,654 | A | 5/1995 | Kleiger | |
| 5,439,313 | A | 8/1995 | Blaha et al. | |
| 5,549,457 | A * | 8/1996 | Flores | E01C 19/176 404/111 |
| 5,773,496 | A | 6/1998 | Grubba | |
| 5,795,929 | A | 8/1998 | Grubba | |
| 5,851,085 | A | 12/1998 | Campbell | |
| 5,895,173 | A | 4/1999 | O'Brien et al. | |
| 5,957,621 | A | 9/1999 | Clark, Jr. et al. | |
| 5,981,061 | A | 11/1999 | Hegemann | |
| 6,079,901 | A | 6/2000 | Banks et al. | |
| 6,089,785 | A | 7/2000 | Bergman | |
| 6,113,309 | A | 9/2000 | Hollon | |
| 6,382,523 | B1 | 5/2002 | Hedegard | |
| 6,776,557 | B2 | 8/2004 | Barnat et al. | |
| 6,802,464 | B2 | 10/2004 | Marconnet | |
| 6,805,516 | B2 | 10/2004 | Barnat et al. | |
| 6,918,714 | B2 | 7/2005 | Chambard | |
| 7,438,764 | B1 | 10/2008 | Hill | |
| 7,448,825 | B2 | 11/2008 | Kasahara et al. | |
| 7,448,826 | B2 | 11/2008 | Laury | |
| 7,488,138 | B2 | 2/2009 | Buschmann | |
| 7,503,724 | B2 | 3/2009 | Blacklidge | |
| 7,572,081 | B2 | 8/2009 | Buschmann | |
| 7,595,356 | B2 | 9/2009 | Lommerts et al. | |
| 7,798,744 | B2 | 9/2010 | Larson et al. | |
| 7,927,038 | B2 | 4/2011 | Dawson | |
| 7,972,429 | B2 | 7/2011 | Crews | |
| 8,021,076 | B2 | 9/2011 | Hoppe | |
| 8,329,250 | B2 * | 12/2012 | Exline | C08L 95/00 404/72 |
| 8,439,597 | B2 | 5/2013 | Diamond | |
| 8,465,224 | B2 | 6/2013 | Price et al. | |
| 8,702,342 | B2 | 4/2014 | Price et al. | |
| 8,740,498 | B2 | 6/2014 | Velicky | |
| 8,764,340 | B2 | 7/2014 | Campbell | |
| 8,968,457 | B2 | 3/2015 | Payne | |
| 9,416,503 | B1 * | 8/2016 | Sargent | E01C 23/14 |
| 9,435,084 | B2 | 9/2016 | Bartoszek | |
| 9,567,716 | B2 | 2/2017 | Rainwater | |
| 9,784,843 | B2 * | 10/2017 | Dolinar | G01S 19/14 |
| 2003/0226290 | A1 * | 12/2003 | Savard | E01C 19/006 37/348 |
| 2007/0199476 | A1 | 8/2007 | Bobee et al. | |
| 2008/0008525 | A1 | 1/2008 | Dawson | |
| 2009/0097918 | A1 * | 4/2009 | Larson | E01C 19/21 404/75 |
| 2010/0127106 | A1 | 5/2010 | Fornasier | |
| 2010/0143035 | A1 | 6/2010 | Dawson | |
| 2011/0166266 | A1 | 7/2011 | Dawson | |
| 2011/0206455 | A1 | 8/2011 | Blacklidge | |
| 2011/0313088 | A1 | 12/2011 | Binkley | |
| 2012/0219359 | A1 | 8/2012 | Baltus | |
| 2014/0112717 | A1 | 4/2014 | Yu | |
| 2014/0219722 | A1 | 8/2014 | Velicky | |
| 2014/0353394 | A1 | 12/2014 | Foster | |
| 2014/0363231 | A1 | 12/2014 | Bartoszek | |
| 2016/0130474 | A1 | 5/2016 | Dongre | |
| 2016/0208098 | A1 | 7/2016 | Naidoo | |
| 2016/0265169 | A1 | 9/2016 | Kriech et al. | |
| 2016/0355999 | A1 | 12/2016 | Bartoszek | |
| 2017/0356136 | A1 | 12/2017 | Kriech | |

FOREIGN PATENT DOCUMENTS

| | | | | |
|---|---|---|---|---|
| CN | 202509377 | U | 10/2012 | |
| CN | 203625779 | U | 6/2014 | |
| CN | 203795278 | U | 8/2014 | |
| DE | 1 534 429 | A1 | 9/1969 | |
| EP | 0643171 | A1 * | 3/1995 | E01C 23/163 |
| FR | 818 518 | A | 9/1937 | |
| FR | 843 987 | A | 7/1939 | |
| GB | 2 420 144 | A | 5/2006 | |
| WO | WO-2007018362 | A1 * | 2/2007 | E01C 23/22 |

OTHER PUBLICATIONS

Anonymous: "Polyguard Pavement Underseal and Waterproofing Membranes", XP-055289880, Ennis, TX 75120-0755, USA, dated May 23, 2016, Retrieved from Internet: URL:http://www.polyguardproducts.com/products/highway/datasheets/665_NW-75.pds [retrieved on Jul. 20, 2016] (pp. 1-4).

(56) References Cited

OTHER PUBLICATIONS

Anonymous: "Rehabilitation of Concrete Pavements with Polyguard NW-75 Prior to Asphalt Overlay", XP055289887, Retrieved from Internet: URL:http://www.polyguardproducts.com/products/highway/concreterehab.htm [retrieved on Jul. 20, 2016], May 23, 2016 (pp. 1-3).
DeVries, Jeff et al., "Iowa DOT Hardin County SR 57", Oct. 19, 2016 (6 pgs).
European extended Search Report from corresponding European application No. 16159379.3 dated Aug. 2, 2016 (14 pgs).
European extended Search Report from corresponding European application No. 16159499.9 dated Sep. 16, 2016 ((9 pgs).
Hailesilassie Biruk W. et al., "Testing of blister propagation and peeling of orthotropic bituminous waterproofing membranes", *Materials and Structures*, London, GB, vol. 48, No. 4, 11/21/20163 (pp. 1095-1108).
McDaniel, Rebecca S., , A. Shah, and J. Olek, "Longitudinal Joint Specifications and Performance", Publication FHWA.IN/JTRP-2012/29, Joint Transportation Research Program, Indiana Dept. of Transportation and Purdue University, West Lafayette, Indiana, 2012 (2 pgs).
Sorensen E.V., "Protecting Bridge Reinforcement", *Concrete Engineering International, Concrete Society*, Camberley, GB, vol. 6, No. 3, Sep. 1, 2002 (p. 58).
U.S. Final Office Action from corresponding U.S. Appl. No. 15/064,814 dated Aug. 8, 2018 (22 pgs).
"Asphalt Swan Hill—Rolling & Joint heating Asphalt Video 4.mov", Apr. 5, 2011, https://www.youtube.com/watch?v=4Hz5zrqdqUw.
Brown, Harry E., "Joint Sealant Materials for Concrete Pavement Repairs", *Virginia Transportation Research Counsel*, Jan. 1991, (pp. 179-220).
Buncher, Mark, Ph.D., P.E., "Best Practices for Asphalt Longitudinal Joints", Asphalt Institute, *National Pavement Preservation Conference*, Aug. 29, 2012, (60 pages).
"Carlson Joint Density Attachments (Compaction)", Jan. 28, 2015, https://www.youtube.com/watch?v=xoUmBnS6J8w.
"Colorado DOT Distress Manual for HMA and PCC Pavements . . . Pavement Preservation",*National Center for Pavement Preservation*, Oct. 2004, (51 pages).
"Comprehensive Pavement Design Manual", *Chapter 8—Pavement Joints*, Revision 1, Jul. 2, 2002, (8 pages).
Concrete Paving Technology, "Joint and Crack Sealing and Repair for Concrete Pavements", *American Concrete Pavement Association*, 1995, (32 pages).
"Construction and Materials Manual", *Wisconsin Department of Transportation*, Chapter 4, Section 21, Jul. 2013, (3 pages).
Duval, John, P.E., "Best Practices for HMA Joint Construction", Idaho Asphalt Conference, *SemMaterials*, Oct. 25, 2007, (10 pages).
Eacker, Michael J., et al., Evaluation of Various Concrete Pavement Joint Sealants, *Michigan Department of Transportation MDOT*, Testing and Research Section, Construction and Technology Division, Work Plan No. 137, Research Project G-0300, Research Report No. R-1376, May 2000, (19 pages).
European extended Search Report from corresponding European application No. 17198070.9 dated Feb. 27, 2018 (9 pgs).
Fowler, David W., et al., Pavement Repair Guidelines for Longitudinal Joints, *Center for Transportation Research, The University of Texas at Austin, CTR Technical Report* 5-5444-01-1, Nov. 2010, (66 pages).
"Guide for Design and Construction of New Jointed Plain Concrete Pavements (JPCPs)", *Division of Design, Office of Pavement Design, Pavement Design & Analysis Branch*, Jan. 9, 2008, (37 pages).
"Heat Design Equipment—Joint Asphalt Repair", Dec. 14, 2009, https://www.youtube.com/watch?v=nlxb5y9lIAU.
"Illinois DOT Longitudinal Joint Study 2012", Feb. 20, 2016, https://www.youtube.com/watch?v=JnMpX7QR1h8.
"J Band Void Reducing Asphalt Membrane", Mar. 2, 2018, https://www.youtube.com/watch?v=v8zIMY9thu8.
"J-Band Results", *J-Band*, https://www.thejointsolution.com/results/.
"Joint and Crack Maintenance", Division 4—CW3250—R7, Dec. 2008, (4 pages).
"JOINTBOND Asphalt Longitudinal Joint Stabilizer 2", Jan. 11, 2018, https://www.youtube.com/watch?v=OsEHtcSseX0.
Jung, Youn su, et al., "Best Practices of Concrete Pavement Transition Design and Construction," *Texas Transportation Institute*, , Report 0-5320-1, Oct. 2006, (91 pages).
Kandhal, Prithvi S., et al., "Longitudinal Joint Construction Techniques for Asphalt Pavements", *NCAT Report No. 97-4*, Aug. 1997, (26 pages).
Kandhal, Prithvi S., et al., Evaluation of Various Longitudinal Joint Construction Techniques for Asphalt Airfield Pavements, *Presented at 2007 FAA Worldwide Airport Technology Transfer Conference*, Apr. 2007, (18 pages).
Kuennen, Tom, "Correcting Problem Concrete Pavements", *Road Science*, May 2003, (pp. 32-38).
"Longitudinal Joint Construction Best Practices", *Flexible Pavements of Ohio Field Operations Committee*, Feb. 18, 2015, (1 page).
"Longitudinal Joint Tack", May 20, 2016, https://www.youtube.com/watch?v=_1jsoTagyxQ.
Mallick, Rajib B., et al., "Project 04-05: Improved Perf9romance of Longitudinal Joints on Asphalt Airfield", *Airfield Asphalt Pavement Technology Program* (*AAPTP*), Dec. 20, 2007, (162 pages).
"Pavement Design Manual", *Ohio Department of Transportation Office of Pavement Engineering*, Jul. 2014, (109 pages).
"Pavement Joint Adhesive", *S-1* (*2331*) *Pavement Joint Adhesive*, Sep. 2, 2010, (2 pages).
"Pavement Preservation Guidelines", *South Dakota Department of Transportation*, Feb. 2010 (79 pages).
"Rigid pavement Joint Sealant", Oct. 3, 2016, https://www.youtube.com/watch?v=tEdhOmQIZwo.
Scherocman, James A., "Construction of Durable Longitudinal Joints", Sep. 1, 2008 (63 pages).
"Schmidt Construction cutting longitudinal Joint with Wheel", Sep. 18, 2014, https://www.youtube.com/watch?v=2j9n5AdNk8k.
"Smooth Racetrack Reconstruction", *Asphalt Contractor Staff*, Oct. 1, 2004, https://www.forconstructionpros.com/pavement-maintenance/preservation-maintenance/planers-milling-machines/article/10306788/smooth-racetrack-reconstruction.
"Standard Practice for Sealing Joints and Cracks in Rigid and Flexible Pavements", *Unified Facilities Criteria* (*UFC*), UFC 3-250-08FA, Jan. 16, 2004 (55 pages).
Thompson, Vern, "The Use of Asphalt Rubber for Crack Sealing in Asphalt Concrete Pavements and for Joint Sealing in Portland Cement Concrete Pavements", *For Presentation at the "Third" National Seminar on Asphalt Rubber*, Oct. 30-31, 1989 (30 pages).
U.S. Office Action from corresponding U.S. Appl. No. 15/064,814 dated Mar. 15, 2018 (15 pages).
U.S. Office Action from corresponding U.S. Appl. No. 15/064,814 dated Jan. 22, 2019 (11 pages).
Williams, R. Christopher, et al, "Quality Control/Quality Assurance Testing for Joint Density and Segregation of Asphalt Mixtures", *Iowa State University*, Apr. 2013, (68 pages).
European extended Search Report from corresponding European application No. 17198070.9 dated Feb. 27, 2018 (9 pages).
U.S. Office Action from corresponding U.S. Appl. No. 16/276,214 dated Mar. 15, 2019 (14 pages).
U.S. Office Action from corresponding U.S. Appl. No. 16/103,466 dated Mar. 18, 2019 (10 pages).
U.S. Office Action from corresponding U.S. Appl. No. 15/646,912 dated Sep. 12, 2017 (10 pages).
U.S. Office Action from corresponding U.S. Appl. No. 15/646,912 dated Feb. 14, 2018 (7 pages).
U.S. Office Action from corresponding U.S. Appl. No. 15/064,819 dated Mar. 8, 2017 (18 pages).
U.S. Notice of Allowance from corresponding U.S. Appl. No. 15/064,819 dated Jun. 29, 2017 (18 pages).
U.S. Office Action from corresponding U.S. Appl. No. 15/401,995 dated Mar. 8, 2017 (18 pages).
Chinese Office Action from corresponding Chinese application No. 201610134145X dated May 14, 2019 (21 pgs).
Chinese Office Action from corresponding Chinese application No. 201610137273X dated May 30, 2019 (16 pgs).

(56) References Cited

OTHER PUBLICATIONS

Huang, Baoshan et al., "Evaluation of Longitudinal Joint Construction Techniques for Asphalt Pavements in Tennessee", *Journal of Materials in Civil Engineering*, Nov. 2010 (11 pgs).
Kim, Eric Mu-Young, "Evaluation of Asphalt Longitudinal Joint Construction and Practices in South Carolina", *All Theses*. 2735—*A Thesis Presented to the Graduate School of Clemsen University*, Aug. 2017 (194 pgs).
Mallela, Jagannath et al., "Evaluation of Longitudinal Joint Tie Bar System", *Colorado Dept. of Transportation—DTD Applied Research & Innovation Branch*, Final Report No. CDOT-2011-12, Sep. 2011 (117 pgs).
McDaniel, Rebecca S. et al., "Longitudinal Joint Specifications and Performance", *Joint Transportation Research Program*, *Indiana Dept. of Transportation and Purdue University*, Publication FHWA/IN/JTRP-2012/29, 2012, (54 pgs).
NRRA Flexible Team, "Longitudinal Joint Construction", *National Road Research Alliance*, Sep. 2018 (19 pgs).
Shanley, Laura, "Development and Evaluation of Longitudinal Joint Sealant in Illinois", Physical Research Rept. No. 168, Apr. 2019 (65 pgs).
U.S. Office Action from corresponding U.S. Appl. No. 16/453,550 dated Aug. 2, 2019 (10 pages).
Williams, Stacy G., "HMA Longitudinal Joint Evaluation and Construction", *University of Arkansas, Dept. of Engineering*, Final Report TRC-0801, Feb. 2011 (90 pgs).

* cited by examiner

APPARATUS AND METHOD FOR APPLYING ASPHALT BINDER COMPOSITIONS INCLUDING VOID REDUCING ASPHALT MEMBRANE COMPOSITIONS FOR PAVING APPLICATIONS

RELATED APPLICATIONS

The present application is a continuation of U.S. Non-Provisional patent application Ser. No. 15/401,990, filed Jan. 9, 2017 which is a continuation of U.S. Non-Provisional patent application Ser. No. 15/064,814, filed Mar. 9, 2016 which in turn is based upon U.S. Provisional Application Ser. No. 62/130,918, filed Mar. 10, 2015 and 62/302,338 filed Mar. 2, 2016 to each of which non-provisional and provisional applications priority is claimed under 35 U.S.C. § 120 and of each of which the entire disclosures are hereby expressly incorporated by reference.

TECHNICAL FIELD

The present invention relates to the installation and repair of paved surfaces. More particularly the present invention relates equipment/apparatus and methods for applying asphalt binder compositions including void reducing asphalt membrane compositions for asphalt paving and repair applications.

BACKGROUND ART

The present inventors have developed a void reducing asphalt membrane composition for asphalt paving applications which void reducing asphalt membrane composition is placed down beneath edge portions of asphalt paving passes and or between adjacent asphalt paving passes during the construction of an asphalt pavement. This void reducing asphalt membrane composition is the subject matter of a copending application which describes the void reducing asphalt membrane composition and discloses how it can be applied to a surface by using various methods such as coating, rolling, spraying, etc.

Longitudinal asphalt pavement construction joints are difficult to compact properly, usually resulting in a high void content that is susceptible to water and air intrusion. With time, the effects of water related damage, results in premature deterioration of the joint area. Maintenance can be very labor intensive, using multiple personnel using pour pots to apply cold or hot joint sealant/crackfiller materials. Hot kettles with hand wands are also used for application of hot sealants/crackfillers. Asphalt distributors can also apply hot or warm bituminous products, either through a wand or a single nozzle spraying on the spray bar. The spray bar nozzle is the fastest application method, but lacks ability to apply a heavier application in the direct area of the longitudinal joint or crack. Instead, it applies a uniform fan of material over the general longitudinal joint/crack area.

The present inventors has proposed applying a heavy application of an asphalt binder composition including a void reducing asphalt membrane composition comprising an asphaltic binder in a strip or band in the area where a longitudinal asphalt pavement joint will be constructed and/or in the area where side edges of a paving pass will be laid. Ideally the strip or band of the void reducing asphalt membrane composition has a thickness of 1/16 to 3/8 inches or greater so as to provide a sufficient amount of the composition that allows the composition to migrate upward into the overlaying asphalt mixture.

In initial testing the void reducing asphalt membrane composition has been applied using similar techniques used to apply joint/crackfiller materials to an existing aged pavement joint; however, these techniques are too labor intensive.

The present invention is directed equipment/apparatus and methods for applying an asphalt binder composition including a void reducing asphalt membrane composition for asphalt paving applications.

DISCLOSURE OF THE INVENTION

According to various features, characteristics and embodiments of the present invention which will become apparent as the description thereof proceeds, the present invention provides an apparatus for applying an asphalt binder composition to a roadway during construction or repair of an asphalt pavement which comprises:

a mobile vehicle having a chassis extending in a longitudinal direction which longitudinal direction is aligned with a forward/rearward direction of travel of said mobile vehicle;

at least one storage tank supported on the chassis containing an asphalt binder composition; and at least one spray nozzle configured to dispense the asphalt binder composition from the at least one storage tank in a longitudinal strip or band having a width that is no greater that a width of the asphalt binder composition dispensed by one of the at least one spray nozzle.

The present invention further provides a method of applying an asphalt binder composition to a roadway during construction or repair of an asphalt pavement which comprises:

providing:

a mobile vehicle having a chassis extending in a longitudinal direction which longitudinal direction is aligned with a forward/rearward direction of travel of said mobile vehicle;

at least one storage tank supported on the chassis containing an asphalt binder composition; and at least one spray nozzle configured to dispense the asphalt binder composition from the at least one storage tank in a longitudinal strip or band having a width that is no greater that a width of the asphalt binder composition dispensed by one of the at least one spray nozzle, moving the mobile vehicle along a roadway to be repaired or paved with asphalt; and dispensing the asphalt binder by means of the at least one spray nozzle in said longitudinal strip or band.

BRIEF DESCRIPTION OF DRAWINGS

The present invention will be described with reference to the attached drawings which are given as non-limiting examples only, in which.

BEST MODE FOR CARRYING OUT THE INVENTION

Figure 1:
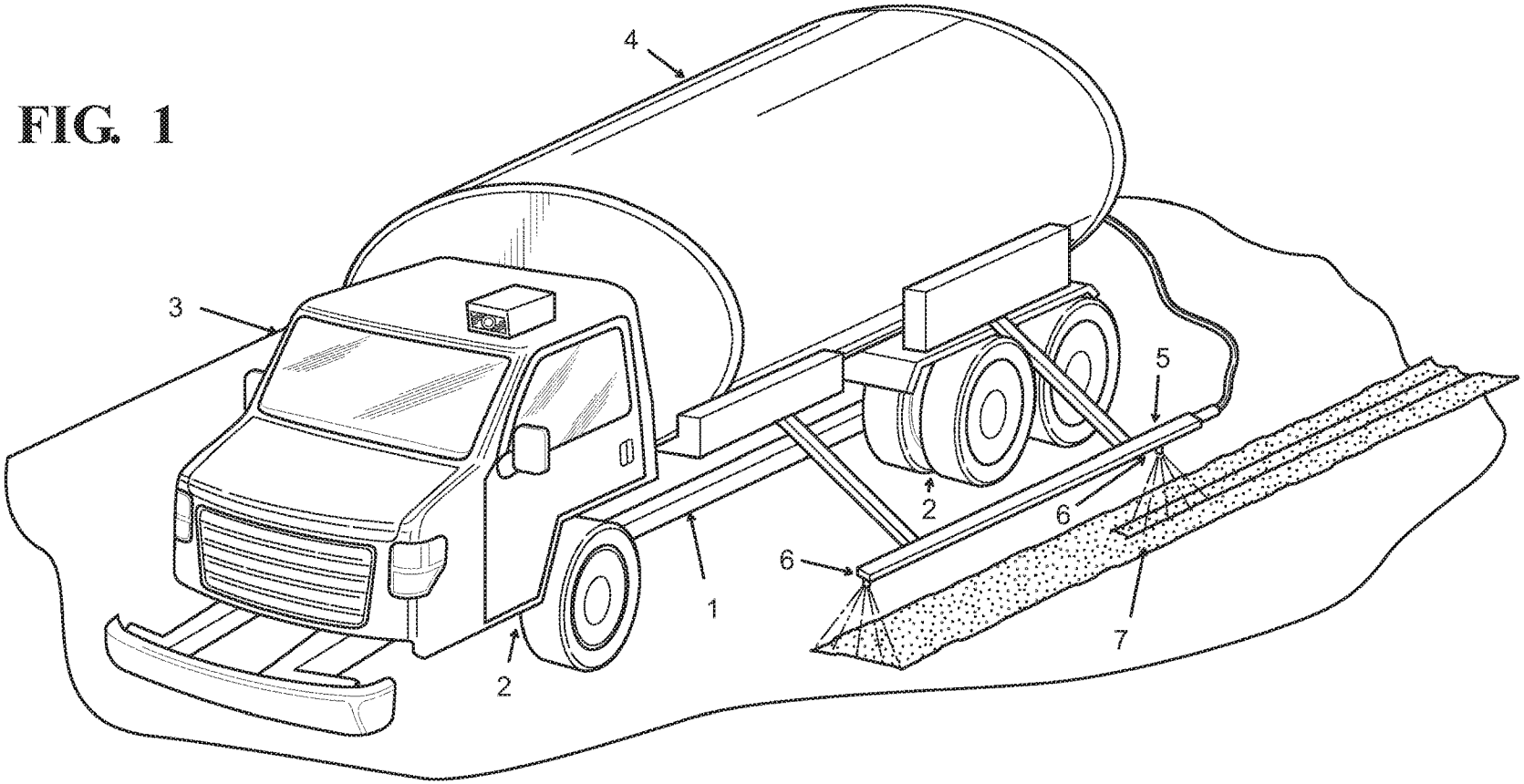
FIG. 1 is a perspective view of an application vehicle according to one embodiment of the present invention.

The present invention is directed to equipment/apparatus and methods for applying asphalt binder compositions including void reducing asphalt membrane compositions for asphalt paving and repair applications.

The invention involves the use of a mobile application vehicle such as a trailer or a self-propelled truck having a tank for storing an asphalt binder composition and a pump system capable of delivering the asphalt binder composition to a spraying system that includes a plurality of spray nozzles that are coupled to a spray bar.

Asphalt distributor trucks have been in existence since they were horse drawn; however, to date all asphalt distributor trucks involve the use of spray systems that are positioned transverse to the direction of travel in order to apply a film of asphaltic binder such as a tack coat across a width of a roadway.

According to the present invention application equipment/apparatus to apply a strip or band of an asphalt binder composition including a void reducing asphalt membrane composition involves the use of a spray bar that is aligned parallel to the direction of travel of an application vehicle. In further embodiments one or more spray application nozzles may be provided on the spray bar. The use of multiple nozzles allows the desired thickness of a strip or band of the asphalt binder composition to be built up over a narrow area by successive application from each nozzle. The nozzles may be selected to provide differing widths of application of the void reducing asphalt membrane composition over the area to be covered. According to one embodiment of the present invention the use of different spray pattern widths or nozzle sizes falling in line with each can create a cross section of an asphalt binder composition such as a void reducing asphalt membrane composition that is thicker in the center than along the outer edges. This can be preferential when trying to apply a void reducing asphalt membrane composition in an existing roadway crack or on a roadway where the intended area of the longitudinal construction pavement joint will be placed from a new application of asphalt paving mixture material. Such a parallel spray bar may be provided on either or both sides of the application vehicle. In further embodiments two or more aligned spray bars could be provided on either or both sides of the application vehicle. In even further embodiments two or more independent substantially linearly or parallel aligned spray nozzles could be used that are not connected directly to a common spray bar.

In addition to the parallel spray bar that is provided to lay down a strip or band of the asphalt binder composition of the present invention, the application vehicle may also include a traditional transverse spray bar for purposes of applying an asphalt composition such as a tack layer for a subsequent asphaltic overlay. The parallel spray bar and the transverse spray bar may be used simultaneous or separately to apply different or similar or the same asphalt binder composition.

According to non-limiting embodiments of the present invention the application vehicle may have one compartment that can apply the same asphaltic binder composition transversely as a tack coat and longitudinally as a longitudinal construction joint asphalt binder composition including a void reducing asphalt membrane. According to different embodiments the application vehicle may have more than one compartment and may contain an asphaltic binder composition for the tack coat application that is delivered to a transverse spray bar and a different asphaltic binder composition for the intended area of the longitudinal asphalt pavement construction joint application that is delivered to the parallel application spray bar.

During the course of the present invention is was discovered that when an asphalt binder composition including a void reducing asphalt membrane is applied through a parallel spray bar an airborne, thin-strand, asphalt webbing can be created when the asphalt binder contacts the pavement surface. The airborne asphalt webbing can create several issues. The airborne asphalt webbing results in loss of application amount on the intended application area. In addition, the airborne asphalt webbing may drift onto vehicles travelling near this application. The airborne asphalt webbing may also collect on the application vehicle and paver sensor equipment. The present inventors have developed a method to address the airborne asphalt webbing which method involves the use of an air knife that is parallel spray bar. A curtain of air provided by the air knife will force the webbing to the pavement in the area of the intended application. The air knives may be adjusted to approximate the angle of the edge of the spray coming from the nozzles on the parallel bar.

A guidance system for applying longitudinal strips or bands of the void reducing asphalt membrane composition in the correct location prior to paving may be employed. One example of such a guidance system comprises a laser guidance system that can project a target for the application vehicle or driver to follow. The guidance system may be used on one or both sides of the application vehicle to allow accurate application of a void reducing asphalt membrane composition to a centerline construction paving joint area and/or along the edge line construction joint area. It is also within the scope of the present invention to incorporate a GPS guidance system onto the application vehicle.

In further embodiments of the invention the application vehicle can comprise an asphalt paving machine which is provided with a leading parallel spray bar or nozzle system that applies a strip or band of void reducing asphalt membrane composition prior to or after an overlay or pass of asphalt pavement.

FIG. 1 is a perspective view of an application vehicle according to one embodiment of the present invention. The application vehicle includes a chassis 1 that is supported by a plurality of axles 2 in a conventional manner. The chassis 1 supports a cab 3 that can house an engine and provides a cabin for a driver. The chassis 1 of the application vehicle also supports a tank 4 for storing various asphalt binder compositions under agitation and heating.

A spray bar 5 extends from one side of the application vehicle which includes a plurality of nozzles 6 for spraying the asphalt composition stored in the tank 4 onto a surface to be paved. In FIG. 1 a strip or band of the asphalt composition that is sprayed on a roadway is identified by reference numeral 7. As shown the nozzles 6 are aligned so as to build up a thickness of the strip or band of asphalt composition 7.

While FIG. 1 depicts two nozzles 6 on spray bar 5 it is to be understood that any number of spray nozzles can be used and separate or plural spray bars can be included on one of both sides of the application vehicle. Alternatively a plurality of individual substantially linearly aligned spray nozzles that are not supported by a common spray bar can be used.

Figure 2A:
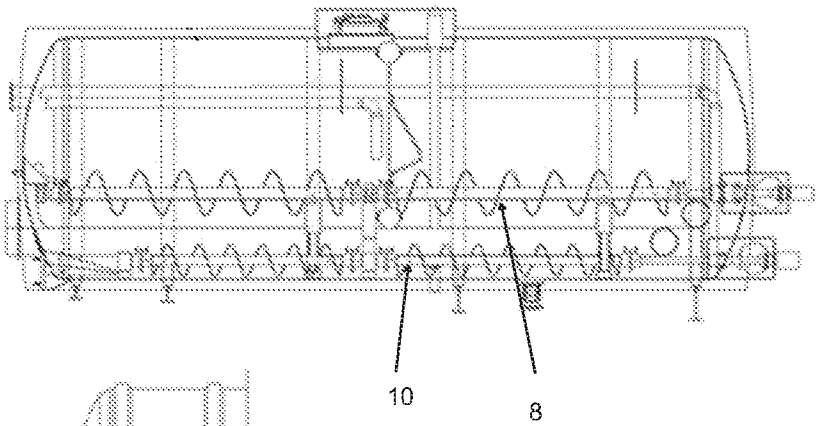
FIG. 2*a* is a schematic side elevational view of the tank of an application vehicle according to one embodiment of the present invention.
Figure 2B:
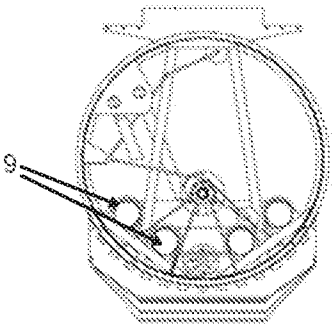
FIG. 2*b* is cross sectional view of the tank of FIG. 2*a* taken along section lines B-B.
Figure 2C:
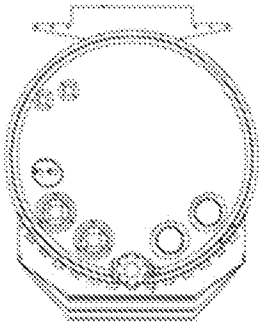
FIG. 2*c* is a cross sectional view of the tank of FIG. 2*a* taken alone section lines C-C.
Figure 2D:
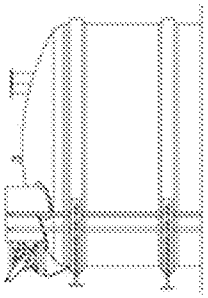
FIG. 2*d* is a schematic side view of the front end of the tank of FIG. 2*a*.

FIG. 2*a* is a schematic side elevational view of the tank of an application vehicle according to one embodiment of the present invention. FIG. 2*b* is cross sectional view of the tank of FIG. 2*a* taken along section lines B-B. FIG. 2*c* is a cross sectional view of the tank of FIG. 2*a* taken alone section lines C-C. FIG. 2*d* is a schematic side view of the front end of the tank of FIG. 2*a*.

The tank 4 is of conventional design and includes means for agitating and heating asphalt binder compositions contained therein. A reversible mixing auger 8 is provided in the tank 4 which provides agitation of the asphalt binder composition within the tank 4. Also provided are a number of heating pipes 9 through which air heated by a diesel or propane burner (not shown) is passed within the tank 4 to maintain the asphalt binder composition at a desired temperature. In an alternative embodiment heated oil could be circulated through the heating pipes 9.

A reversible flow auger 10 is provided in the tank 4 to direct the asphalt binder composition toward a drain port and/or a port that transfers the asphalt binder composition to the spraying assembly including spray bars 5 and nozzles 6.

Figure 3:
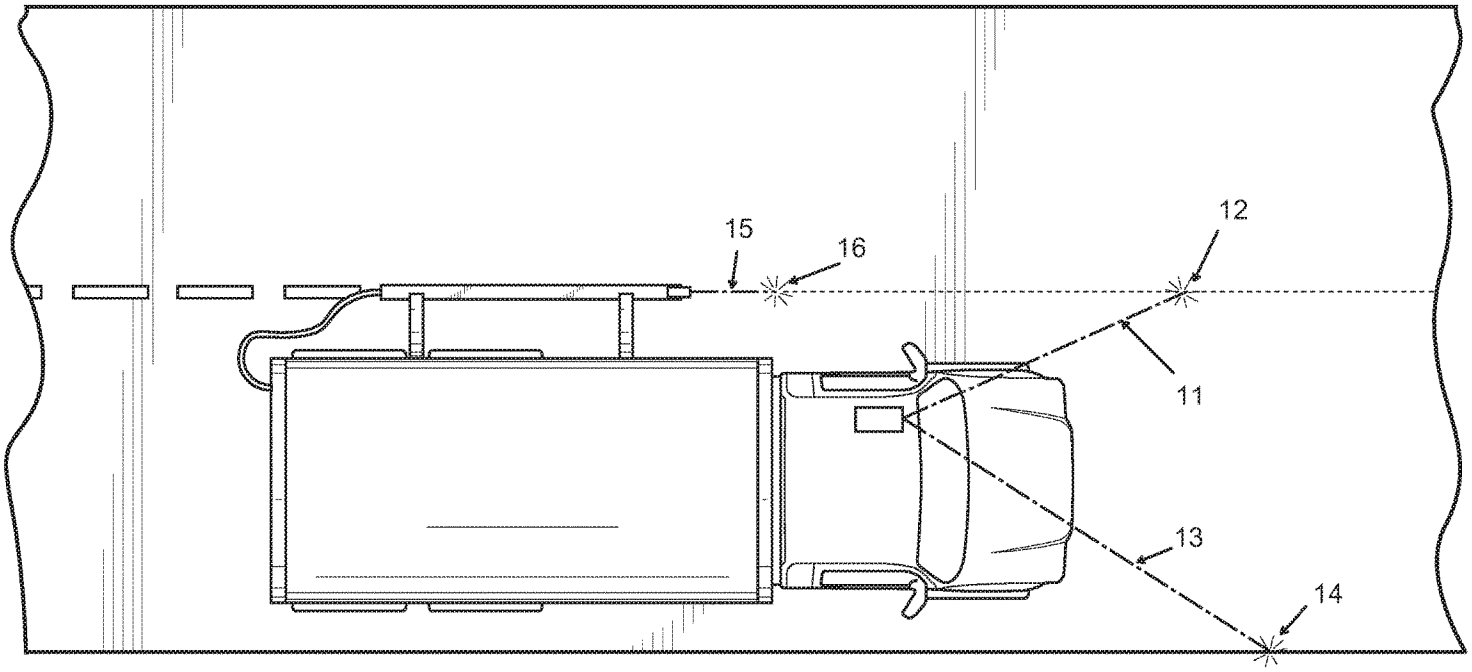
FIG. 3 schematic top view of an application vehicle according to one embodiment of the present invention depicting embodiments of guidance systems.

FIG. 3 schematic top view of an application vehicle according to one embodiment of the present invention depicting embodiments of guidance systems. The application vehicle of the present invention can be used together with known guidance systems, including laser guidance systems and GPS guidance systems.

FIG. 3 depicts an embodiment of the present invention in which a front guidance system can be used to direct the steering of the application vehicle and a spray bar guidance system which monitors and controls the alignment of the parallel spray bar so as to ensure the asphalt binder composition is applied in a desired location.

Figure 4:
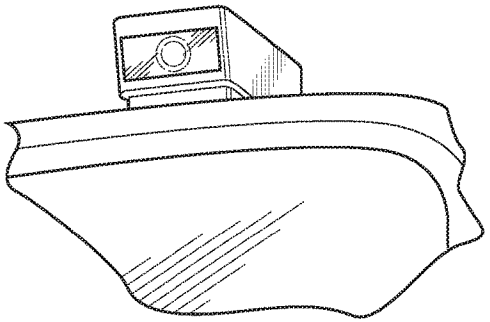
FIG. 4 is a schematic side elevational view of vehicle guidance system.

FIG. 4 is a schematic side elevational view of vehicle guidance system. The vehicle guidance system is mounted on a forward part of the application vehicle and can comprise any conventional laser guidance system or GPS guidance system. The laser guidance system depicted in FIG. 4 includes a first laser 11 that is aimed to project an illuminated spot 12 at middle area of a surface to be paved whereat an intended area of a longitudinal pavement construction joint will be developed and where a strip or band of void reducing asphalt membrane compound needs to be applied. A second laser 13 can also be included that is aligned to project an illuminated spot 14 along the side edge of the surface to be paved. The illuminated laser beam spots 12 and 14 can be captured by an imaging camera which in turn can automatically control and correct the steering of the application vehicle as needed.

In an alternative embodiment the application vehicle operator/driver could use a reference mark or sighting device to manually control or adjust the steering of the application vehicle to move in proper alignment with the illuminated laser beam spots 12 and 14.

A spray bar guidance system can be mounted on a side the application vehicle and can comprise any conventional laser guidance system or GPS guidance system. When a laser guidance system is used it can a laser that projects an illuminated spot a short distance ahead of the parallel spray bar which can be captured by an imaging camera and used to adjust the position of the spray bar which can be coupled to the application vehicle by an adjustable bracket or support assembly.

The use of a guidance system in conjunction with the application vehicle will aid in accurate placement of asphalt binder composition through the parallel spray bar in the intended area of a longitudinal asphalt pavement construction joint area prior to placement of an asphalt overlay mixture. The guidance system may be used from either or both sides of the application vehicle or can be used simultaneously with parallel spray bars that apply asphalt binder compositions on both sides of the application vehicle at the same time.

Figure 5:
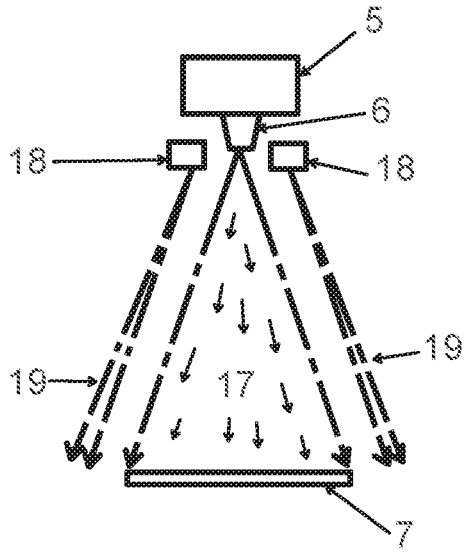
FIG. 5 is a schematic cross-sectional view of an air knife used with a spray bar according to one embodiment of the present invention.

FIG. 5 is a schematic cross-sectional view of an air knife used in conjunction with a spray bar according to one embodiment of the present invention. The spray bar 5 is shown with one of the nozzles 6 ejecting a spray pattern of asphalt binder composition 17 onto a roadway to form a strip or band of the asphalt binder composition 7. An air knife 18 is provided which extends along a length of the spray bar 5 which directs a curtain of air 19 that will force any webbing to the pavement where the strip or band of the asphalt composition 7 is being laid down. FIG. 5 depicts air knife 18 as creating air curtains on either side of the spray pattern of the asphalt composition 17. As discussed above air knives can be adjusted so that the angle of the air curtains approximate the angle of the edge(s) of the spray pattern of the asphalt composition 17, or any angle that is determined to contain asphalt webbing. In FIG. 5 the center of the spray pattern of the asphalt composition 17 is substantially perpendicular to the roadway surface (not shown). If this angle is increased, for example so that the spray pattern 17 is angled outward from the spray bar 5 and so that the so that asphalt webbing is produced only on the outer side of the spray pattern, an air knife 18 could be provided that directs an air curtain 19 on only the outer side of the spray pattern 17. The length of the air knives and their position along the spray bar 5 can be increased or adjusted as necessary to contain asphalt webbing. Likewise the number and angular orientation of the air knives can also be adjusted. Furthermore a common air knife can be provided along the length of the spray bar 5 or separate air knives can be provided for individual ones or two or more of the nozzles 6. In further embodiments the air curtain(s) can comprise heated air.

Reference herein and through to asphalt binder composition or asphaltic binder is to be understood as encompassing a void reducing asphalt membrane composition, a tack coating composition as well as any asphalt based composition or sealing composition that can be used in conjunction with asphalt pavement construction or repair.

In a typical application of a void reducing asphalt membrane composition the spray nozzles are of a size to apply a strip or band of void reducing asphalt membrane composition having a width of between about 4 to 24 inches and at a thickness of between from about 1/16 to about 3/8 of an inch. These widths and thickness ranges are exemplary of typical applications; however, it is to be understood that other widths and thicknesses and combinations thereof could be used.

The spray nozzles may be the same size or have different sizes to provide different application rates and/or application widths. In this regard the transverse cross section of the spray application from the spray nozzles may be uniform. Otherwise the spray distribution can be thicker and/or wider in one area than another along a laid down strip or band of material. According to one embodiment of the present invention the heaviest application of a laid down strip or band of material will be near the center of the application width.

The distance between adjacent spray nozzles may be the same or may be different. In this regard a greater distance provided between a pair of adjacent spray nozzles will allow a sprayed asphalt binder composition to cure or cool to some extent before the next nozzle applies material over the same area.

In addition to applying a strip or band of asphalt binder composition the present invention a further embodiment of the present invention provides for a spray of water, air or suitable chemical to be applied at a location between the spray nozzles for purposes of accelerating cooling and/or curing of the asphalt binder composition.

As discussed above a transverse spray bar may be used on an application vehicle in conjunction with a parallel spray bar. The transverse bar may be used for applying an asphaltic binder as in a tack coat application. The parallel bar may be used to apply an asphaltic binder in the intended area of the longitudinal asphalt pavement construction joints. The spray bars may be used simultaneously or separately. As can be understood the application vehicle may have more than one compartment to hold asphaltic materials for spray application. The compartments may contain the same asphaltic materials or may hold different asphaltic materials. Further the compartment may each include agitators and heating systems to maintain the asphaltic materials desired temperatures.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and encompassed by the attached claims.

What is claimed is:

1. An apparatus for applying an asphalt binder composition to a roadway, the apparatus comprising:

a mobile vehicle having a chassis extending in a longitudinal direction, such that the longitudinal direction is aligned with a forward/rearward direction of travel of said mobile vehicle;

at least one storage tank containing the asphalt binder composition, said asphalt binder composition comprising an asphaltic material; and an asphalt binder spraying system comprising a plurality of spray nozzles aligned substantially linearly in the longitudinal direction, wherein the plurality of spray nozzles are configured to dispense the asphalt binder composition in a downward direction to form a longitudinal strip or band onto the roadway, wherein the plurality of spray nozzles are coupled to a common spray bar.

2. The apparatus for applying an asphalt binder composition to a roadway according to claim 1, wherein the plurality of spray nozzles are individually configured so that they do not all dispense the same amount of the asphalt binder composition.

3. The apparatus for applying an asphalt binder composition to a roadway according to claim 1, wherein the plurality of spray nozzles do not all dispense the asphalt binder composition in the same individual widths.

4. The apparatus for applying an asphalt binder composition to a roadway according to claim 1, further comprising at least one air knife system for containing airborne asphalt webbing.

5. The apparatus for applying an asphalt binder composition to a roadway according to claim 1, further comprising at least one guidance system for guiding movement of the mobile vehicle or guiding a position of the plurality of spray nozzles.

6. The apparatus for applying an asphalt binder composition to a roadway according to claim 5, wherein the at least one guidance system comprises a laser guidance system or a GPS guidance system.

7. The apparatus for applying an asphalt binder composition to a roadway according to claim 1, further comprising a transverse spray bar having a plurality of other nozzles which is separate from the asphalt binder spraying system and is mounted to the chassis so as to extend in a transverse direction which is orthogonal to the longitudinal direction.

8. The apparatus for applying an asphalt binder composition to a roadway according to claim 1, wherein the at least one storage tank is supported on the chassis.

9. The apparatus for applying an asphalt binder composition to a roadway according to claim 1, wherein the apparatus further comprises at least one of a heater or an agitator.

10. The apparatus for applying an asphalt binder composition to a roadway according to claim 1, wherein the strip or band has a width of about 4 to about 24 inches.

11. The apparatus for applying an asphalt binder composition to a roadway according to claim 1, wherein the asphalt binder composition comprises a void reducing asphalt membrane composition.

* * * * *